United States Patent [19]

Woolslayer

[11] 4,324,077

[45] Apr. 13, 1982

[54] METHOD OF MOVING A DRILLING RIG LONG AND SHORT DISTANCES

[75] Inventor: Joseph R. Woolslayer, Tulsa, Okla.

[73] Assignee: Lee C. Moore Corporation, Tulsa, Okla.

[21] Appl. No.: 88,555

[22] Filed: Oct. 26, 1979

[51] Int. Cl.[3] ..... E21B 7/02; E04B 1/34; E04N 1/12

[52] U.S. Cl. ..... 52/143; 52/741; 105/32; 105/157 R; 166/79; 280/43.24; 173/23

[58] Field of Search ..... 52/143, 741; 173/23; 105/157 R, 215 C; 180/8 B; 280/43.23, 43.24; 414/787; 166/79

[56] References Cited

U.S. PATENT DOCUMENTS

| | | | |
|---|---|---|---|
| 1,503,992 | 8/1924 | Moore | 173/23 X |
| 2,420,803 | 5/1947 | Tobin | 52/143 |
| 2,817,495 | 12/1957 | Pearl | 173/23 |
| 3,754,361 | 8/1973 | Branham et al. | 52/143 X |
| 3,884,494 | 5/1975 | Ashby et al. | 52/143 X |
| 4,199,298 | 4/1980 | Webre et al. | 280/43.23 X |

*Primary Examiner*—Ernest R. Purser

*Attorney, Agent, or Firm*—Brown, Flick & Peckham

[57] ABSTRACT

A line of detachably connected skid frames is laid down at a first drilling position for supporting an oil well drilling rig having a base seated on the frames with some of them extending away from opposite ends of the base. After the well has been completed, the rig is skidded along the line of frames to one or more nearby drilling locations, but for movement to a more distant drilling location, some of the skid frames then are temporarily attached to the bottom of the base and disconnected from the rest of the frames. Then wheels are attached to the opposite ends of the base, which is raised along with the attached skid frames relative to the wheels to lift the rig. After towing the wheel-supported rig over the ground to a new drilling location, it is lowered until the skid frames attached to it rest on the ground again.

7 Claims, 8 Drawing Figures

2
5
6
7
9
10
1
8
4
3
3
3

2
5
6
7
17
12
15
13
III
1
17
III
14
3

METHOD OF MOVING A DRILLING RIG LONG AND SHORT DISTANCES

In certain locations, notably in the Arctic, it is common practice to skid drilling rigs short distances for drilling directional holes. By keeping the drilling locations or sites close together, much of the required equipment does not have to be moved. Nevertheless, after drilling a group of directional holes in this manner, it may be desirable to drill additional wells some distance away and much farther than it is practicable to skid the rig.

It is therefore an object of this invention to provide a method of moving a well drilling rig from one location to another, in which the rig can be skidded short distances and then provided with wheels for a long distance move.

The preferred embodiment of the invention is illustrated in the accompanying drawings, in which FIG. 1 is a fragmentary side view of a drilling rig in operating position;

Figure 1:
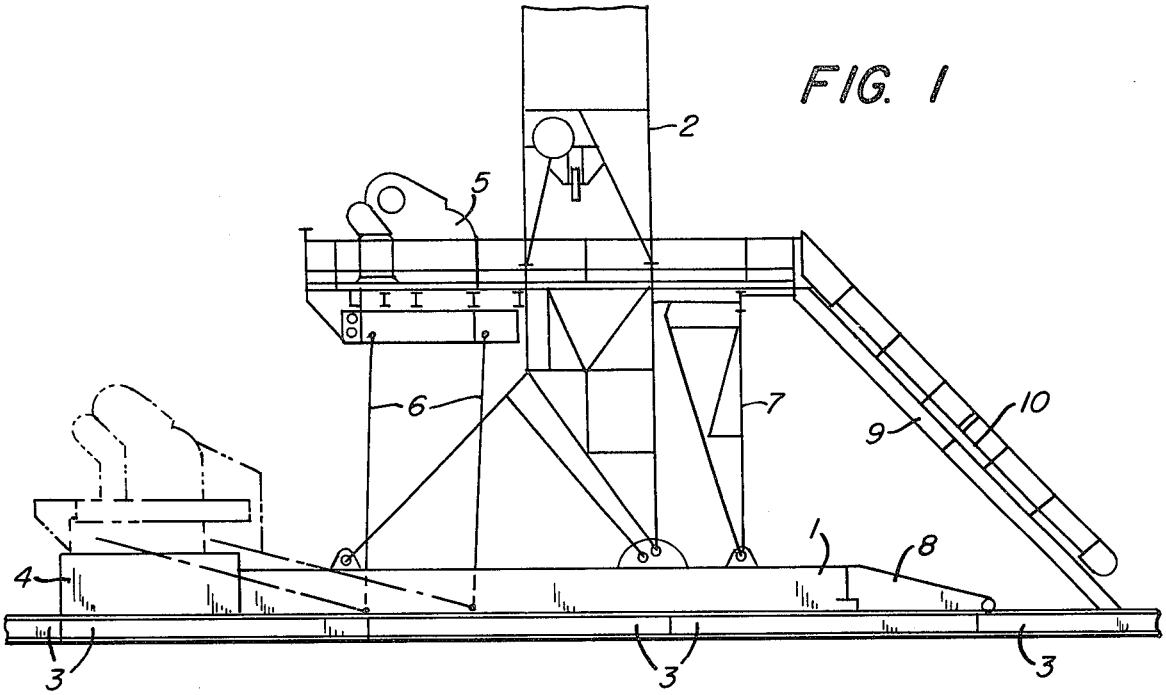

Referring to FIG. 1 of the drawings, a drilling rig is shown that is similar to the one appearing in U.S. Pat. No. 3,803,780. It has a rectangular base 1 on which a high floor mast 2 is mounted. The base rests on skid frames 3 that are detachably connected end to end. For ease of handling, the frames are shorter than the base but they form a continuous line that extends away from the front and rear ends of the base. Preferably, the length of each skid frame 3 is divisible substantially equally into the length of base 1. For example, each skid frame may be about half or a third as long as the base.

Mounted on the skid frames directly behind the base is a temporary support 4 for drawworks 5 that are pivotally connected by parallel links 6 to the base in front of the support. While the drawworks is resting on the support, as shown in dotted lines, it is used for swinging the mast from a reclining position up to upright position in a well known manner and then the drawworks is swung upwardly on the links to a position behind the high floor of the mast, where the links serve as legs that support the drawworks. In front of the mast there is a setback support 7, and a ramp 9 and stairway 10. After the drawworks is raised, the temporary support 4 is removed.

Figure 2:
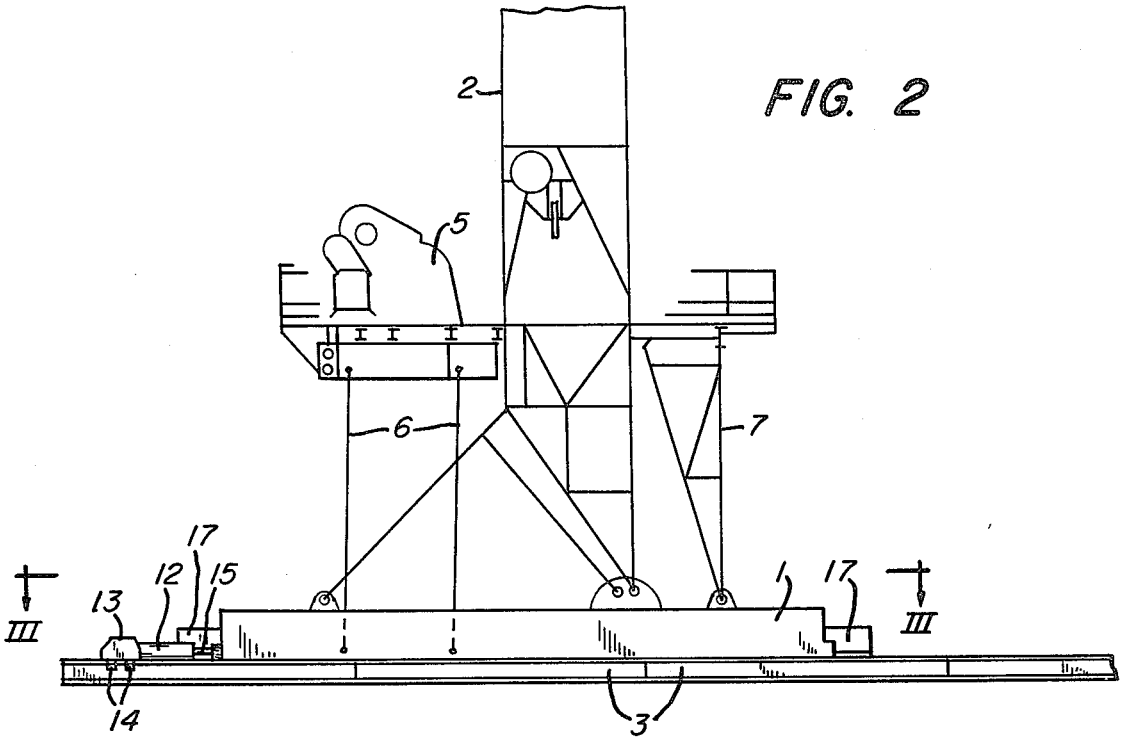
FIG. 2 is similar view, but showing the rig about to be skidded.
Figure 3:
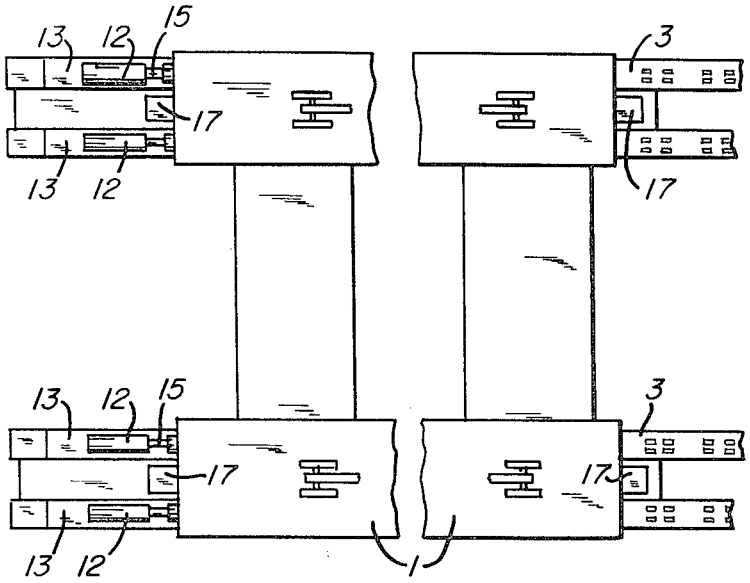
FIG. 3 is an enlarged fragmentary plan view of the rig base and supporting skid frames taken on the line III—III of FIG. 2.
Figure 6:
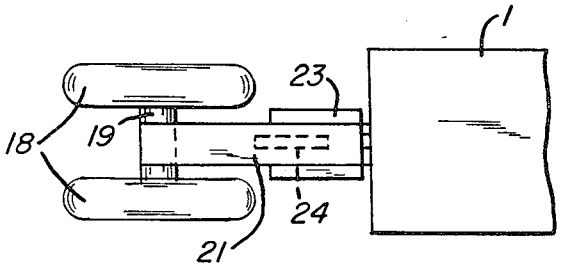
FIG. 6 is an enlarged plan view taken on the line VI—VI of FIG. 5.
Figure 8:
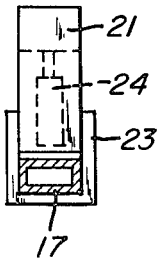
FIG. 8 is an enlarged vertical section taken on the line VIII—VIII of FIG. 5.
Figure 7:
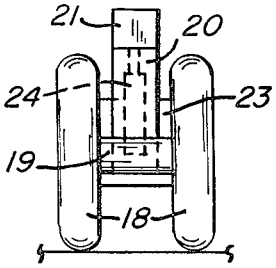
FIG. 7 is an enlarged end view of one of the dollies.

Following completion of a well in the location shown, the base's front end extension 11, and usually the ramp and stairway, are removed and the rig is then skidded along the line of frames 3 to another nearby drilling location. This skidding can be accomplished in various ways, but preferably, as shown in FIGS. 2 and 3, by means of hydraulic cylinders 12 placed behind the base of the rig. Each cylinder has a claw 13 at its rear end provided with lugs 14 that extend down through holes in the beams forming the sides of the underlying skid frame. Projecting from the front end of the cylinder is a piston rod 15 that engages the rear end of the base. When hydraulic pressure is delivered to the rear ends of the cylinders, the piston rods are moved forward to push the base along the skid frames. When the piston rods have reached the end of their strokes they are retracted and the claws are lifted from the skid frame beams supporting them and moved forward along them to another position where their lugs again are set in holes in the beams so that the skidding operation can be repeated. This operation is repeated until the rig arrives at the location desired for drilling another well. As the forwardly moving base leaves a skid frame, that frame can be disconnected from those ahead of it and moved to the front of the line.

Figure 4:
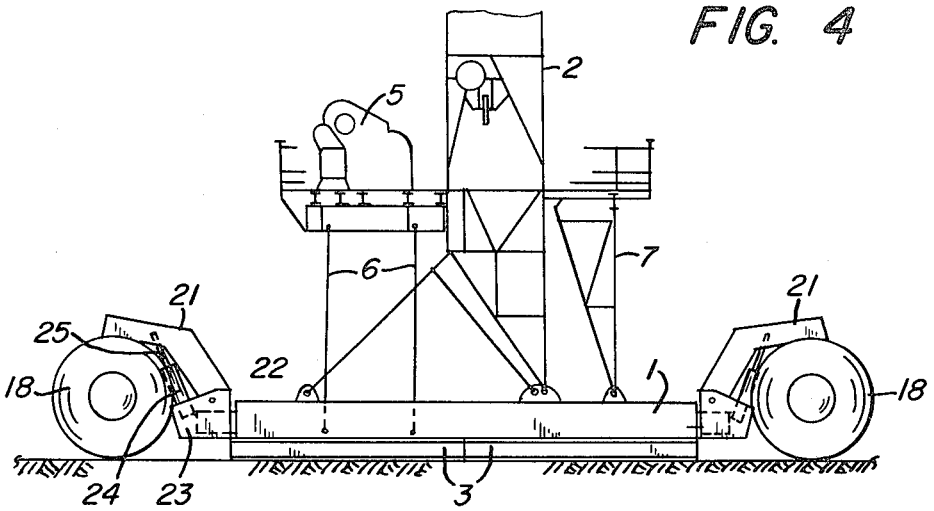
FIG. 4 is a fragmentary side view of the rig equipped with dollies and about to be raised.

After all of the drilling that is practical in that general location has been accomplished and it is desired to transport the rig to a more distant drilling site, the base 1 is skidded along the skid frames whatever distance is necessary to position it over two or more skid frames that are disposed entirely beneath the base. The skid frames completely underlying the base then are detachably connected to it in any suitable manner and are disconnected from the other frames, which are then moved out of the way, as shown in FIG. 4. Dollies are then connected to stub beams 17 projecting from opposite ends of the base.

Figure 5:
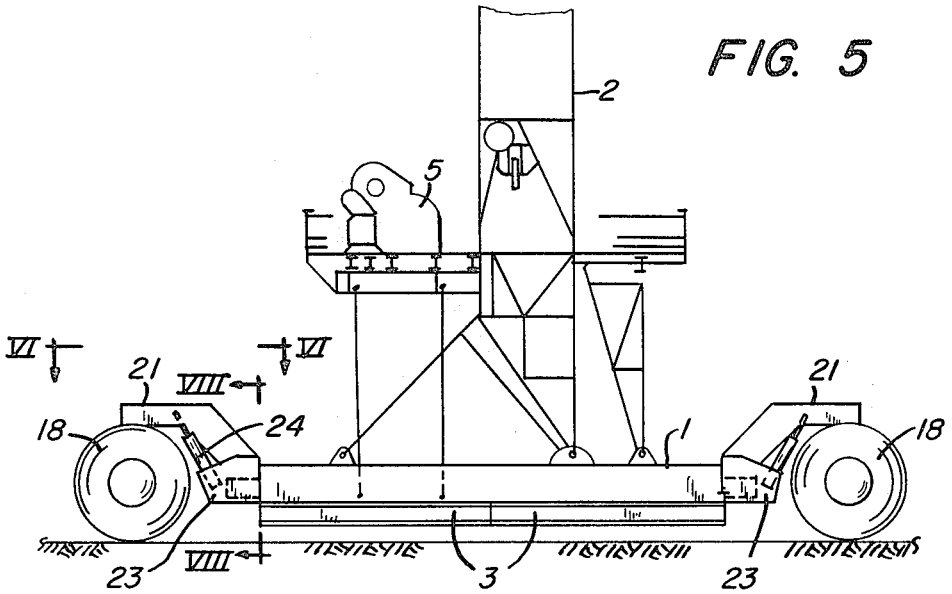
FIG. 5 is a view similar to FIG. 4, but with the rig raised for transportation over the ground.

As shown in FIGS. 4, 6, 7 and 8, each dolly includes a pair of rubber tired wheels 18 connected by an axle encircled by a housing 19 from which a post 20 (FIG. 7) extends upwardly. Secured to the upper end of this post is the upper end of a gooseneck arm 21. The other or lower end of the gooseneck is pivotally mounted on a horizontal axis 22 in a bracket 23 that is detachably connected to one of the stub beams 17. A hydraulic cylinder 24 and its piston rod 25 are pivotally connected to the bracket and the upper part of the gooseneck. After the four dollies have been mounted in place, fluid under pressure is delivered to the upper ends of their cylinders to move the cylinders upwardly on the piston rods. This action raises the rig relative to the wheels and thus lifts the attached underlying skid frames from the ground, as shown in FIG. 5.

The rig now is supported only by the wheels and can be towed or otherwise moved over the ground to another drilling site. Arriving at that site, fluid is released from the dolly cylinders to allow the rig to descend until the underlying skid frames rest on the ground again as shown in FIG. 4. The dollies then can be removed, and the front end extension 11 and the ramp and stairway replaced. After drilling at that location has been completed, the skid frames beneath the base can be disconnected from it and other skid frames connected to the outer ends of those frames. Skidding along the lines of frames thus provided can be accomplished in the same way as explained herein in connection with FIG. 2.

From the drawings and the description herein it will be understood that the apparatus and the disclosed method permits an oil well drilling rig to be skidded short distances from one drilling site to another and moved on wheels over longer distances.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. The method of supporting in a first drilling position an oil well drilling rig having a base and then moving the rig from that position to other drilling locations, comprising laying down a line of skid frames at said first position, detachably connecting the frames end to end, seating said base on some of said frames with frames extending away from opposite ends of the base, skidding the rig along the line of frames from one drilling location to another, temporarily attaching some of the frames to the bottom of said base and disconnecting them from the rest of the frames, attaching wheels to the opposite ends of the base, then raising the base and frames attached thereto relative to said wheels to lift the rig, transporting the wheel-supported lifted rig over the ground to a new drilling location, and then lowering the rig until the frames attached to the base rest on the ground again.

2. The method recited in claim 1, including disconnecting the frames from said base at said new drilling location, laying additional skid frames on the ground at the opposite ends of said base and connecting them to the frames beneath the base, and then skidding the rig along the frames to still another drilling location.

3. The method recited in claim 1 or 2, in which each frame is made with a length divisible substantially equally into the length of the base, and before the frames underlying the base are attached to it the base is adjusted into a position where substantially the entire lengths of said underlying frames are disposed between the ends of the base.

4. The method recited in claim 1, including pivotally connecting gooseneck arms with the opposite ends of said base and said wheels to attach the wheels to the base, and tilting said arms away from the base to raise the base and frames.

5. Well drilling apparatus comprising a drilling rig provided with a base, skid frames supporting the base at a drilling site and detachably connected to its bottom, wheels at the opposite ends of the base, means detachably connecting the wheels to the base, power means connecting said base and wheel-connecting means for raising the base and frames relative to said wheels to lift the rig and permit it to be moved over the ground and then lowered to the ground at a new drilling location, means for connecting additional skid frames at the ends of the base to the frames beneath the base to form a line of frames, and means for skidding the rig along said line of frames after said base has been disconnected from said underlying frames.

6. Well drilling apparatus according to claim 5, in which said means detachably connecting the wheels to the base include brackets rigidly connected to the base, and gooseneck arms pivotally connected to said brackets on horizontal axes, and said means for raising the base and frames include fluid pressure cylinders connected to the arms and brackets.

7. Well drilling apparatus according to claim 5, in which there are two pairs of laterally spaced wheels at each end of said base, each pair of wheels is connected by an axle encircled by a housing, a post rigidly connected to each housing extends upwardly therefrom, the upper end of a gooseneck arm is rigidly connected to the upper end of each post, a pair of brackets are rigidly connected to each end of said base, pivoting means pivotally connect the lower end of each gooseneck arm to one of said brackets on a horizontal axis, and said means for raising the base and frames include fluid pressure actuated means connected with said brackets and the upper portions of said arms.

* * * * *